US007847219B2

(12) United States Patent
Kim et al.

(10) Patent No.: US 7,847,219 B2
(45) Date of Patent: Dec. 7, 2010

(54) ELECTRIC OVEN

(75) Inventors: Wan Soo Kim, Gwangmyung-si (KR); Yong Woo Lee, Seoul (KR); Seong Ho Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 842 days.

(21) Appl. No.: 11/613,506

(22) Filed: Dec. 20, 2006

(65) Prior Publication Data

US 2007/0158340 A1 Jul. 12, 2007

(30) Foreign Application Priority Data

Dec. 20, 2005 (KR) ..... 10-2005-0126335

(51) Int. Cl.

| | |
|---|---|
| ***A21B 3/02*** | (2006.01) |
| ***F24C 15/02*** | (2006.01) |
| ***F24C 15/04*** | (2006.01) |
| ***F24C 15/32*** | (2006.01) |

(52) U.S. Cl. ..... 219/391; 126/198; 126/200

(58) Field of Classification Search ..... None
See application file for complete search history.

(56) References Cited

U.S. PATENT DOCUMENTS

| | | | | |
|---|---|---|---|---|
| 3,659,578 | A * | 5/1972 | Davis et al. | 126/21 R |
| 3,859,499 | A * | 1/1975 | Evans et al. | 219/396 |
| 5,193,522 | A | 3/1993 | Damsteegt et al. | |
| 7,126,097 | B2 | 10/2006 | Kim et al. | |
| 7,228,857 | B2 * | 6/2007 | Kim et al. | 126/198 |
| 2005/0133019 | A1 | 6/2005 | Kim et al. | |
| 2006/0196495 | A1 * | 9/2006 | Kim et al. | 126/198 |
| 2006/0237425 | A1 | 10/2006 | Kim et al. | |
| 2007/0125760 | A1 * | 6/2007 | Kim et al. | 219/391 |

FOREIGN PATENT DOCUMENTS

| | | |
|---|---|---|
| CH | 678913 | 11/1991 |
| CN | 1840969 | 10/2006 |
| DE | 10219348 | 11/2003 |
| EP | 1707884 | 10/2006 |
| EP | 1 793 174 | 6/2007 |

OTHER PUBLICATIONS

English Language Abstract of CH 678913.
English Language Abstract of DE 10219348.
U.S. Appl. No. 11/616,991 to Kim et al., filed Dec. 28, 2006.
U.S. Appl. No. 11/416,327 to Lee et al., filed May 3, 2006.
U.S. Appl. No. 11/412,787 to Kim et al., filed Apr. 28, 2006.
U.S. Appl. No. 11/412,785 to Lee et al., filed Apr. 28, 2006.
U.S. Appl. No. 11/392,755 to Nam et al., filed Mar. 30, 2006.
U.S. Appl. No. 11/392,751 to Nam et al., filed Mar. 30, 2006.

* cited by examiner

*Primary Examiner*—Joseph M Pelham
(74) *Attorney, Agent, or Firm*—McKenna Long & Aldridge LLP

(57) ABSTRACT

An electric oven includes a door and a compartment having an internal space that is selectively closed by the door. The door has a cooling air opening oil a surface facing the compartment, and the compartment has an intake opening configured to receive air exhausted through the cooling air opening. A shield element prevents foreign matter from entering into the door through the cooling air opening.

12 Claims, 10 Drawing Sheets

ELECTRIC OVEN

This application claims the benefit of Korean Patent Application No. 10-2005-0126335, filed on Dec. 20, 2005, which is hereby incorporated by reference in its entirety.

BACKGROUND OF THE INVENTION

1. Field of the Invention

The present invention relates to an electric oven, and more particularly, to an electric oven that can prevent foreign matter from entering into a door through a cooling air opening formed on an inner portion of the door.

2. Description of the Related Art

An electric oven is generally used for baking or cooking food using heat generated by a heating source provided in a compartment. The electric oven is generally a stand-alone type of electric oven or a built-in type of electric oven. The stand-alone type of electric oven is independently installed at a location, and the built-in type of electric oven has a compartment unit which is inserted into a wall or a cabinet.

A conventional electric oven includes a compartment defining a cooking chamber or cavity therein, and a door pivotally mounted on a front portion of the compartment.

The door has a plurality of glass panels spaced apart from each other in a front-to-rear direction. Air is introduced into cooling channels or spaces defined between the glass panels. A door cooling air opening or hole is formed on an upper inner portion of the door, so that the air introduced into the cooling channels or spaces between the glass panels can be exhausted through the door cooling opening. A duct and a fan member are provided on an upper portion of the compartment in order to suck the air exhausted through the door cooling opening.

The air exhausted through the door cooling hole is introduced into the duct through a hole formed on the front portion of the compartment. The air introduced into the duct is exhausted toward the front of the compartment.

The door is configured to open by pivoting frontward about a lower portion of the compartment. Therefore, when a user intends to insert food into, or remove food from, the compartment, the user pulls the door forward to pivot to a horizontal state. The door cooling hole formed on an inner portion of the door faces upward in a exposed condition when the door is in such an opened position.

In this condition, foreign matter, such as juice or food particles, may fall into the door cooling hole. The foreign matter falling into the door cooling hole may be introduced inside of the door. When the door is closed again, the foreign matter may flow down along the air channels or passages defined between the glass panels. Such foreign matter or food particles remain inside the door, causing an offensive odors and sanitary problems.

SUMMARY OF THE INVENTION

Accordingly, the present invention is directed to an electric oven, which substantially obviates one or more problems due to limitations and disadvantages of the related art.

An object of the present invention is to provide an electric oven that can prevent foreign matter from being introduced into a door during insertion or removal of food from a compartment.

Another object of the present invention is to provide an electric oven that can prevent the generation of an offensive odor caused by foreign matter introduced into the door.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, an electric oven includes a door, a compartment having an internal space that is selectively closed by the door, the door having a cooling air opening on a surface facing the compartment, the compartment having an intake opening configured to receive air exhausted through the cooling air opening, and a shield element that prevents foreign matter from entering into the door through the cooling air opening.

The shield element may be detachably attached to the cooling air opening. The shield element may include a mesh filter that filters foreign matter and a sealing member which is connected to the mesh filter and configured to be received into the cooling air opening. The shield element may allow the air to be exhausted through the cooling air opening and prevent foreign matter from entering into the door.

The shield element may include a blocking member provided on the door and configured to selectively open and close the cooling air opening, and an actuator provided on the compartment and configured to selectively engage the blocking member. The shield element may further include an elastic member coupled to the blocking member and configured to bias the blocking member toward the cooling air opening when the door is in an opened condition. The elastic member may bias the blocking member such that the blocking member is prevented from pivoting away from the cooling air opening when the door is in a fully opened condition.

The door may include a receiving hole on a surface facing the compartment, a portion of the actuator being inserted into the receiving hole. A portion of the actuator may be inserted into the cooling air opening. The actuator may be extended forward when the door is in a closed condition, and the actuator may be retracted when the door is in an opened condition. The blocking member may be spaced from the cooling air opening to open the cooling air opening when the door is in a closed condition, and the blocking member may tightly contact an inner surface of the door to close the cooling air opening when the door is in an opened condition.

The shield element may include a blocking member configured to selectively block the cooling air opening and an actuator that allows the blocking member to selectively close the cooling air opening. The compartment may include an exhaust opening through which the air received into the intake opening is exhausted, and a duct communicating the intake opening with the exhaust opening.

In another aspect of the present invention, an electric oven includes a compartment configured to receive food, a door for selectively opening and closing the compartment, and a cooling fan for directing air into the door. The door includes a cooling air opening through which internal air is exhausted, the compartment including an intake opening aligned with the cooling air opening when the door is in a closed condition; and a shield element provided in the cooling air opening, the shield element being configured to allow the internal air to be exhausted out of the door and to prevent foreign matter from entering into the door.

The shield element may include a sealing member received in the cooling air opening and a mesh filter connected to the sealing member.

In still another aspect of the present invention, an electric oven includes a compartment having an intake opening and an exhaust opening at a front portion thereof, a duct connecting the intake opening and the exhaust opening, a door that selectively opens and closes the compartment, the door including a cooling air opening in communication with the intake opening, and a shield element that selectively closes the cooling air opening depending on whether the door is in an opened or a closed condition.

The shield element may include a blocking member provided on the door and configured to selectively open and close the cooling air opening, and an actuator provided on the compartment and configured to selectively engage the blocking member. The shield element may further include an elastic member coupled to the blocking member and configured to bias the blocking member toward the cooling air opening when the door is in an opened condition. The actuator may be extended forward when the door is in a closed condition, and the actuator may be retracted when the door is in an opened condition. The blocking member may be spaced from the cooling air opening to open the cooling air opening when the door is in a closed condition, and the blocking member may tightly contact an inner surface of the door to close the cooling air opening when the door is in an opened condition.

According to the present invention, the introduction of foreign matter into the door can be prevented during a process of moving food in and out of the compartment. In addition, even when foreign matter, such as pieces of the food or juice of the food, fall onto the door cooling hole formed on an inner side of the door, the foreign matter is not introduced into the door.

Furthermore, since the introduction of the foreign matter into the door is prevented, the generation of offensive odor in the door can be prevented.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. The invention may, however, be embodied in many different forms and should not be construed as being limited to the embodiments set forth herein; rather, these embodiments are provided so that this disclosure will be thorough and complete, and will fully convey the concept of the invention to those skilled in the art. Wherever possible, the same reference numbers will be used throughout the drawings to refer to the same or like parts.

Figure 1:
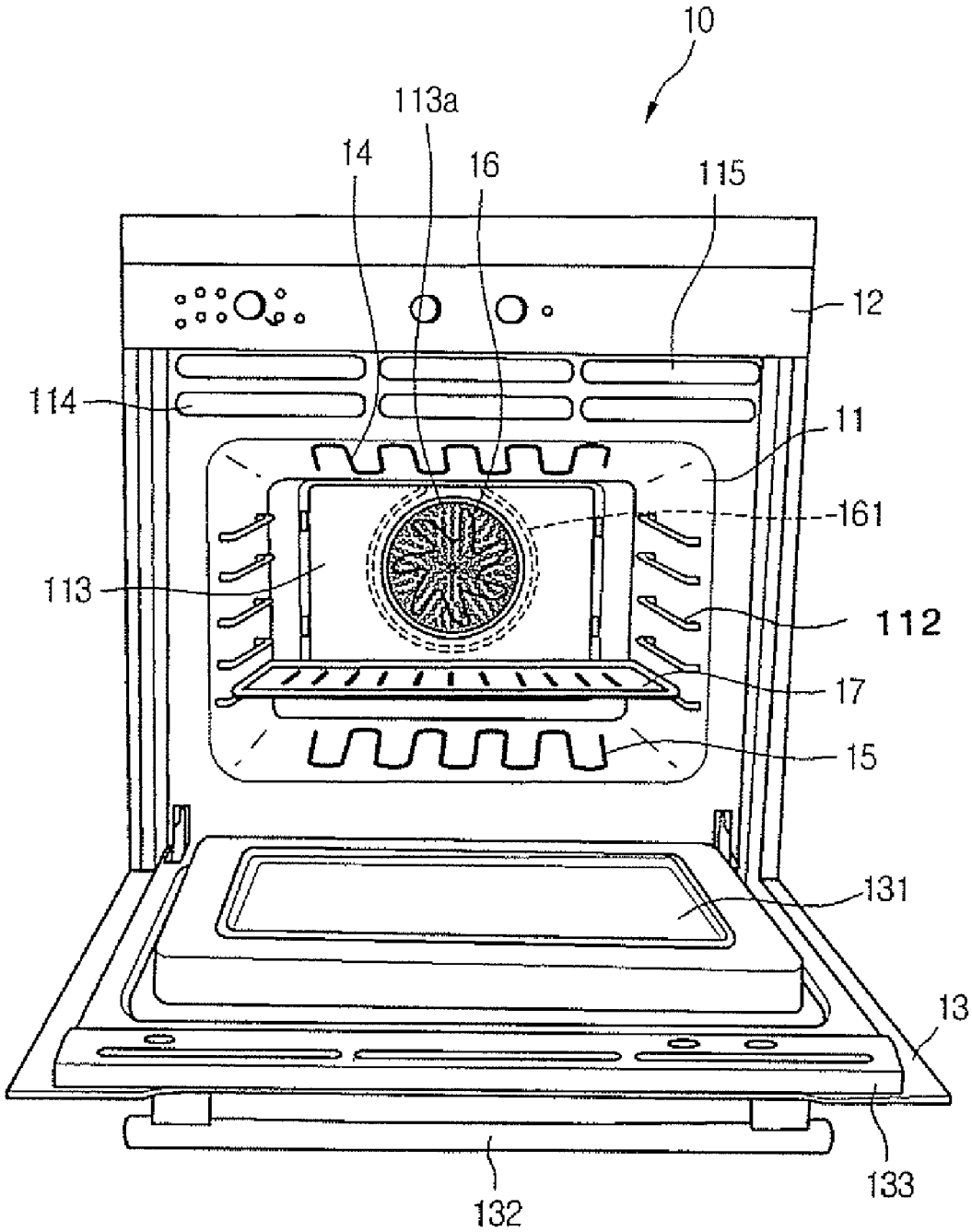
FIG. 1 is a front perspective view of an electric oven according to a first embodiment of the present invention.
Figure 2:
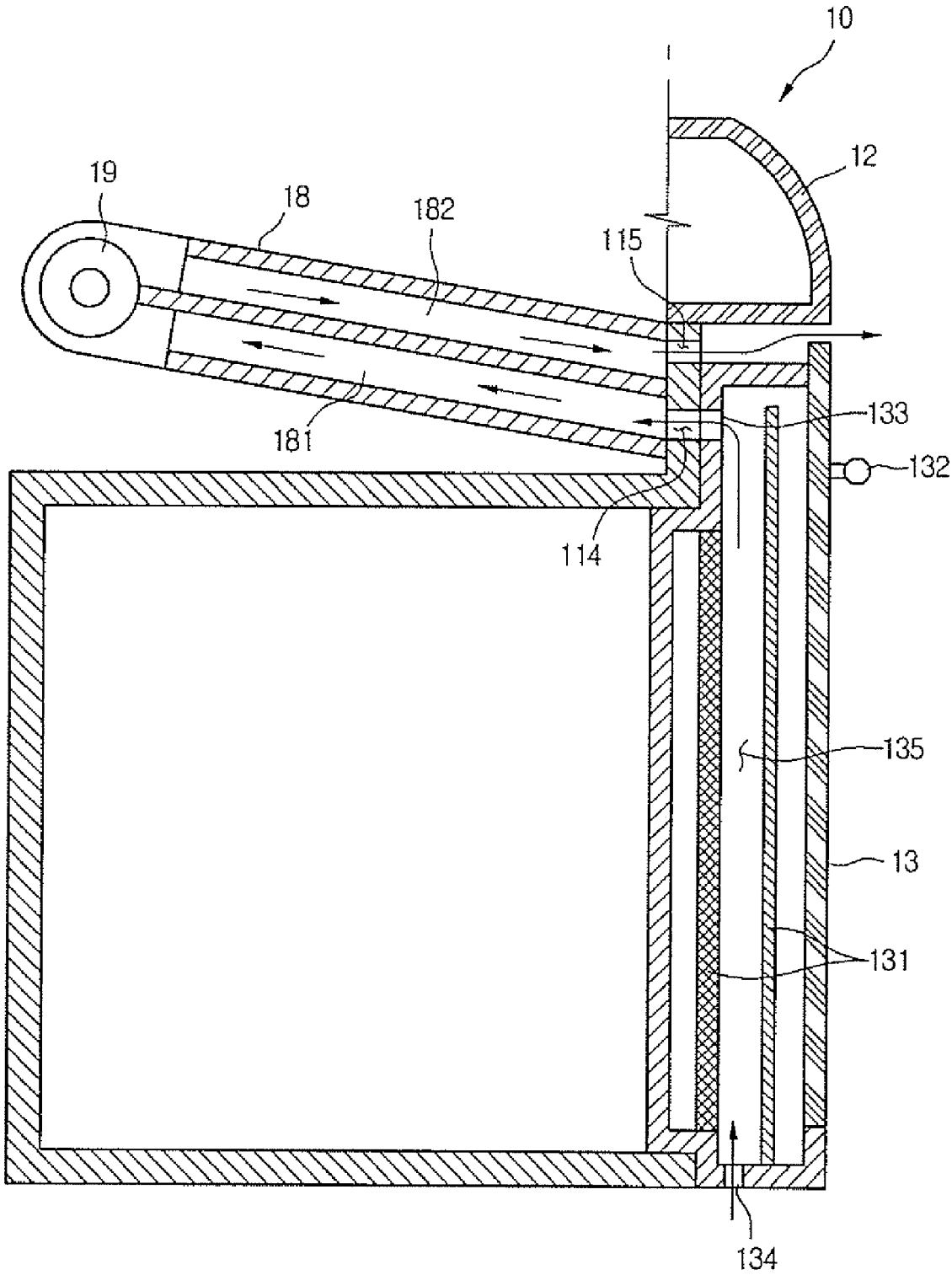
FIG. 2 is a sectional view depicting airflow for cooling a door of the electric oven of FIG. 1.

FIG. 1 is a perspective view of an electric oven according to a first embodiment of the present invention, and FIG. 2 is a sectional view depicting airflow for cooling a door of the electric oven.

Referring to FIGS. 1 and 2, an electric oven 10 according to the first embodiment of the present invention includes a compartment 11, a door 13 pivotally coupled to a front portion of the compartment 11, a control panel 12 provided on an upper front portion of the compartment 11, and a cooling fan 19 and cooling duct 18 that are provided on an upper portion of the compartment 11 to suck air flowing through the door 13. The compartment 11 includes a heating chamber or cavity in which food is cooked.

Tray supports 112 are provided on inner side surfaces of the compartment 11, and are spaced apart from each other in a vertical direction. A tray 17 containing food may be moved in and out of the compartment 11 along the tray supports 112.

The electric oven 10 further includes an upper heater 14 that is provided on an inner top portion of the compartment 11 to emit heat, a lower heater 15 that is provided on an inner lower portion of the compartment 11 to emit heat, and a convection heater 161 that is provided on an inner rear portion of the compartment 11 to emit heat. The heaters may be any suitable type of heating devices.

The convection heater 161 is provided behind a back plate 113 of the compartment, and the heat emitted from the convection heater 161 is directed into the compartment 11 by a convection fan 16. The back plate 113 is provided with a plurality of holes **113*a* through which the heat emitted from the convection heater 161** is directed into the compartment.

In addition, the compartment 11 is provided at an upper front portion with an intake opening or hole 114 through which the air passing through the door 13 is introduced into the cooling duct 18. An exhaust opening or hole 115 through which the air introduced into the cooling duct 18 is exhausted to the room is provided above the intake hole 114.

A door handle 132 is provided on a front portion of the door 13. The door 13 is provided at an inner upper portion with a cooling air opening or hole 133. The door cooling hole 133 is aligned with the intake hole 114 of the compartment 11 when the door is in a closed condition. A plurality of door glass panels 131 are arranged in the door 13 and spaced apart from each other in a front-to-rear direction. A cooling channel or passage 135 is formed between the door glass panels 131. A room air intake hole 134 is formed on an edge of the door 13, such as a lower edge of the door 13.

The cooling duct 18 is provided with an air intake passage 181 along which the air from the door 13 is passed and an air exhaust passage 182 through which the air is exhausted to the room. The air intake passage 181 communicates with the intake hole 114 of the compartment 11 and the air exhaust passage 182 communicates with the exhaust hole 115 of the compartment 11. Any suitable device, such as the cooling fan 19, may be provided for forcing air through the cooling duct 18.

A device is coupled to the door air cooling opening 133 to prevent foreign matter from being introduced into the door. The device may function to selectively open and close the air cooling opening 133.

The following will describe an operation of the electric oven and a door cooling process.

The user first opens the oven door 13 and inserts the tray 17 on which food is loaded into the compartment 11. The user then closes the door 13 and inputs a cooking mode using an operation button provided on the control panel 12. Next, the user pushes the start button.

The heaters 14, 15, and 161 in the compartment 11 are operated to generate heat. At this point, convection current is generated in the compartment 11 by the rotation of the convection fan 16. The food is cooked by the heat.

Meanwhile, when the temperature of the inside of the compartment 11 increases, the heat is transmitted to the door 13, heating the door 13 and the door handle 132. In order to prevent the user from being burnt by the heating of the door 13 and the door handle 132, the door 13 needs to be cooled during the cooking process. Accordingly, the cooling fan 19 provided on an upper portion of the compartment 11 rotates to allow the room air to be introduced through the room air intake hole 134 formed on the lower end of the door 13. The room air introduced into the door 13 flows upward along the cooling passage 135 to absorb the heat transmitted to the door 13. The air heated while flowing along the cooling passage 135 is discharged through the door air cooling hole 133 and introduced through the intake hole 114 formed on the front portion of the compartment 11. The air introduced through the intake hole 114 flows along the intake passage 181 of the cooling duct 18. The airflow direction is changed by the cooling fan 19 and flows along the exhaust passage 182. The air flowing along the exhaust passage 182 is exhausted to the room through the exhaust hole 115 formed on the front portion of the compartment 11.

Figure 3:
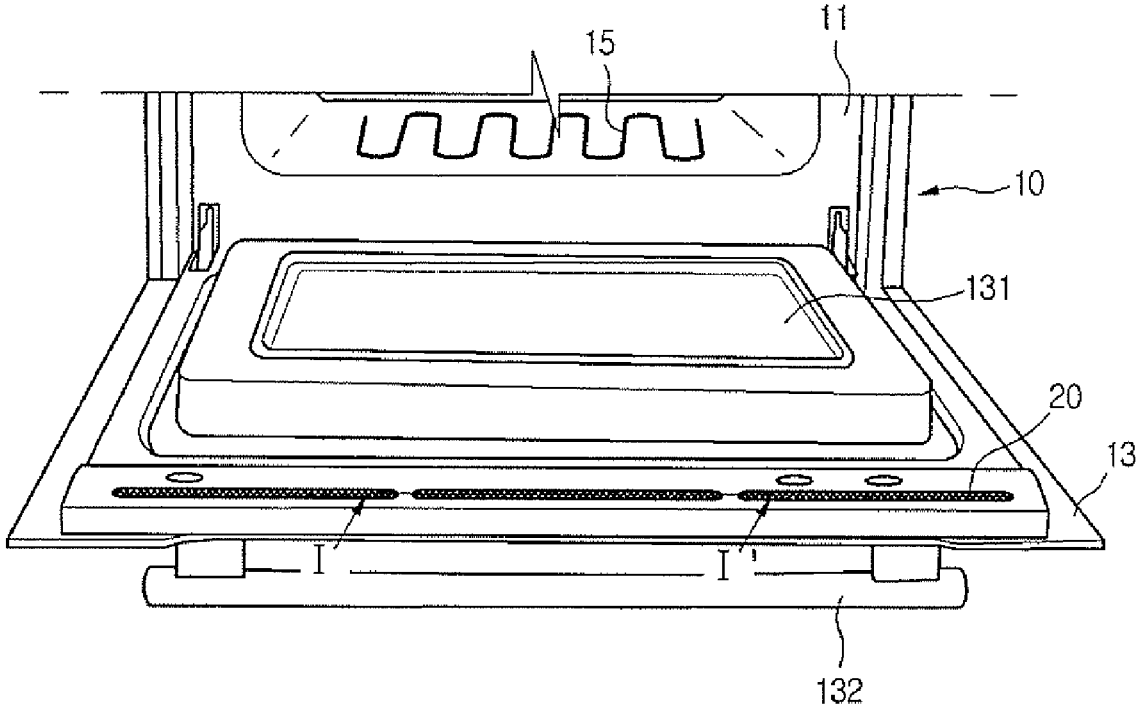
FIG. 3 is a partial perspective view of a door on which a foreign matter introduction preventing device of the first embodiment of the present invention is mounted.
Figure 4:
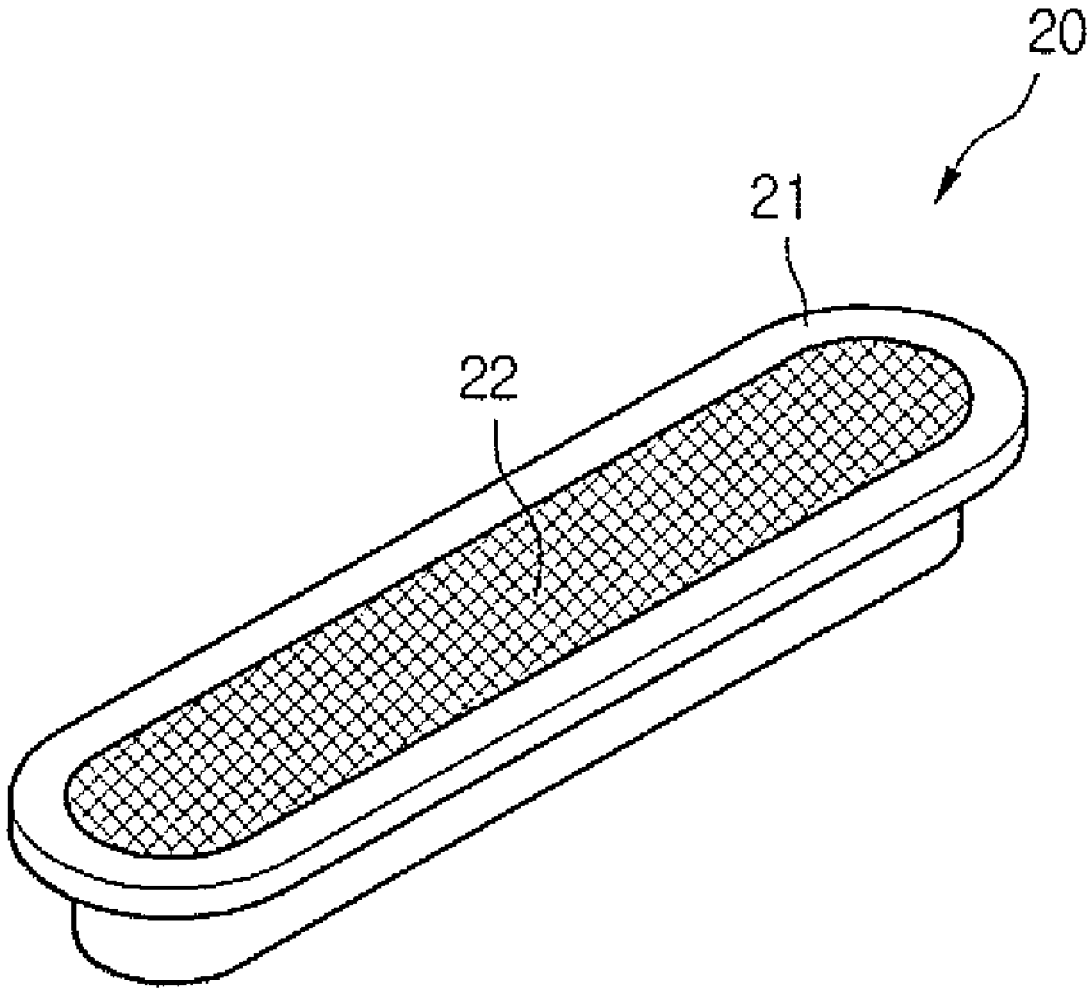
FIG. 4 is a perspective view of a foreign matter introduction preventing device according to the first embodiment of the present invention.

FIG. 3 is a partial perspective view of a door on which a foreign matter introduction preventing device or shield of a first embodiment of the present invention is mounted. FIG. 4 is a perspective view of a foreign matter introduction preventing device or shield according to the first embodiment of the present invention, and FIG. 5 is a sectional view taken along line I-I' of FIG. 3.

Figure 5:
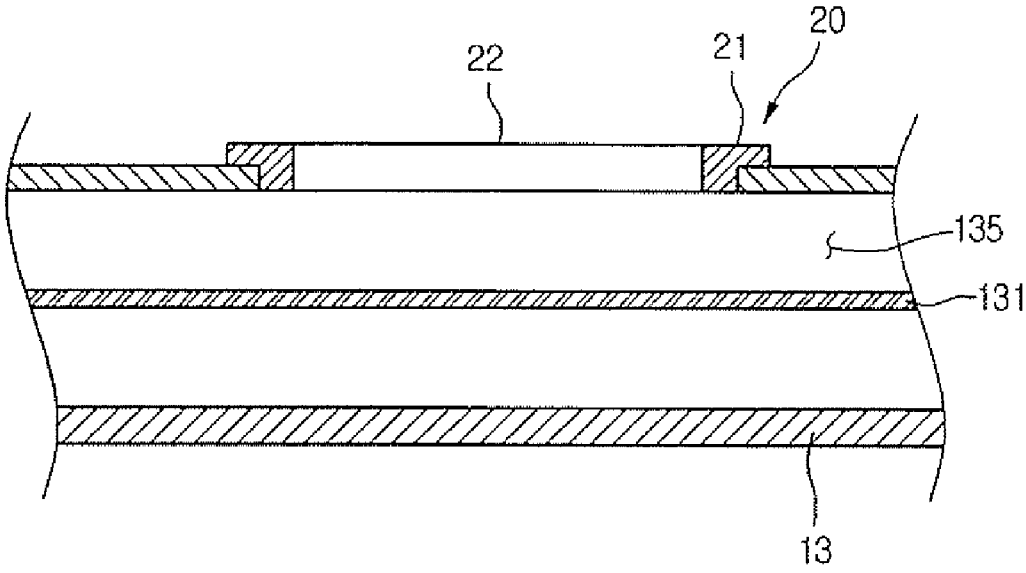
FIG. 5 is a sectional view taken along line I-I' of FIG. 3.

Referring to FIGS. 3 through 5, a foreign matter introduction preventing device 20 is coupled to the door cooling air hole 133 to prevent the foreign matter from entering into the cooling air hole 133.

The foreign matter introduction preventing device or shield 20 includes a mesh filter 22 provided with a plurality of pores, and a sealing member 21 disposed around an outer circumference of the mesh filter 22. The sealing member 21 is received into, and tightly contacts the inner circumference of the cooling air hole 133.

The foreign matter introduction preventing device 20 is detachably attached to the door cooling air hole 133, and may be washed or cleaned by the user after being detached. The mesh filter 22 may be formed of any suitable heat-resistance material that can endure the internal temperature of the compartment 11, such as aluminum wire.

In addition, the sealing member 21 may be formed of any suitable heat-resistance material that is not melted or deformed, even at a high temperature. The foreign matter introduction preventing device 20 does not directly contact internal air of the compartment 11, but closely contacts an upper front surface of the compartment 11. Therefore, although it is not necessary to manufacture the foreign matter introduction preventing device of heat-resistance material which can endure the highest temperature of the compartment 11, it is preferable that it is formed of a material that can endure 100° C., considering the amount of heat transmitted from the compartment 11.

The mesh filter 22 may be formed by densely arranging small diameter wires in a matrix pattern to prevent foreign matter, such as soup or other fluids, from flowing into the door 13. The mesh filter 22 may be formed having pores configured to allow air to pass therethrough, but to prevent liquid from passing therethrough. That is, the liquid cannot pass through the mesh filter 22 due to surface tension.

In addition, the foreign matter introduction preventing device 20 may be detachably attached to the door 13 so that the user can separate and wash the same.

Figure 6:
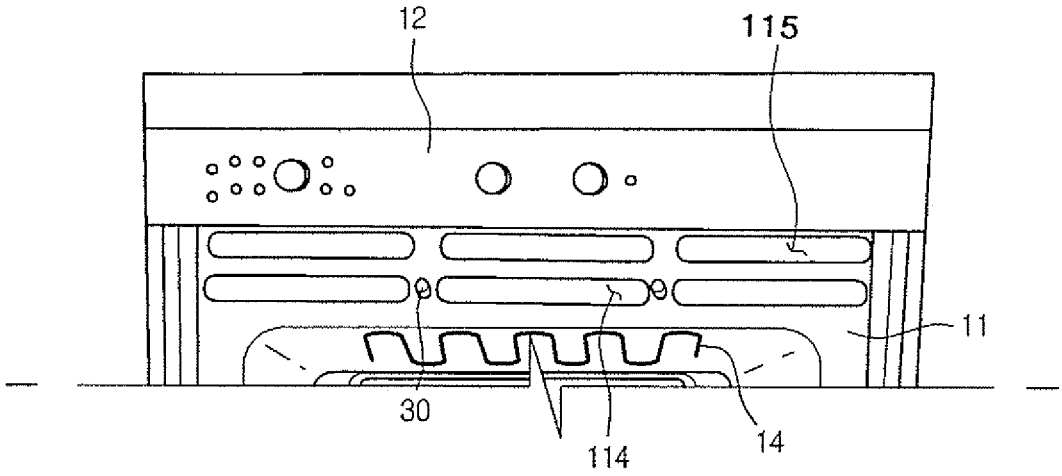
FIG. 6 is a partial view of a compartment of an electric oven according to a second embodiment of the present invention.
Figure 7:
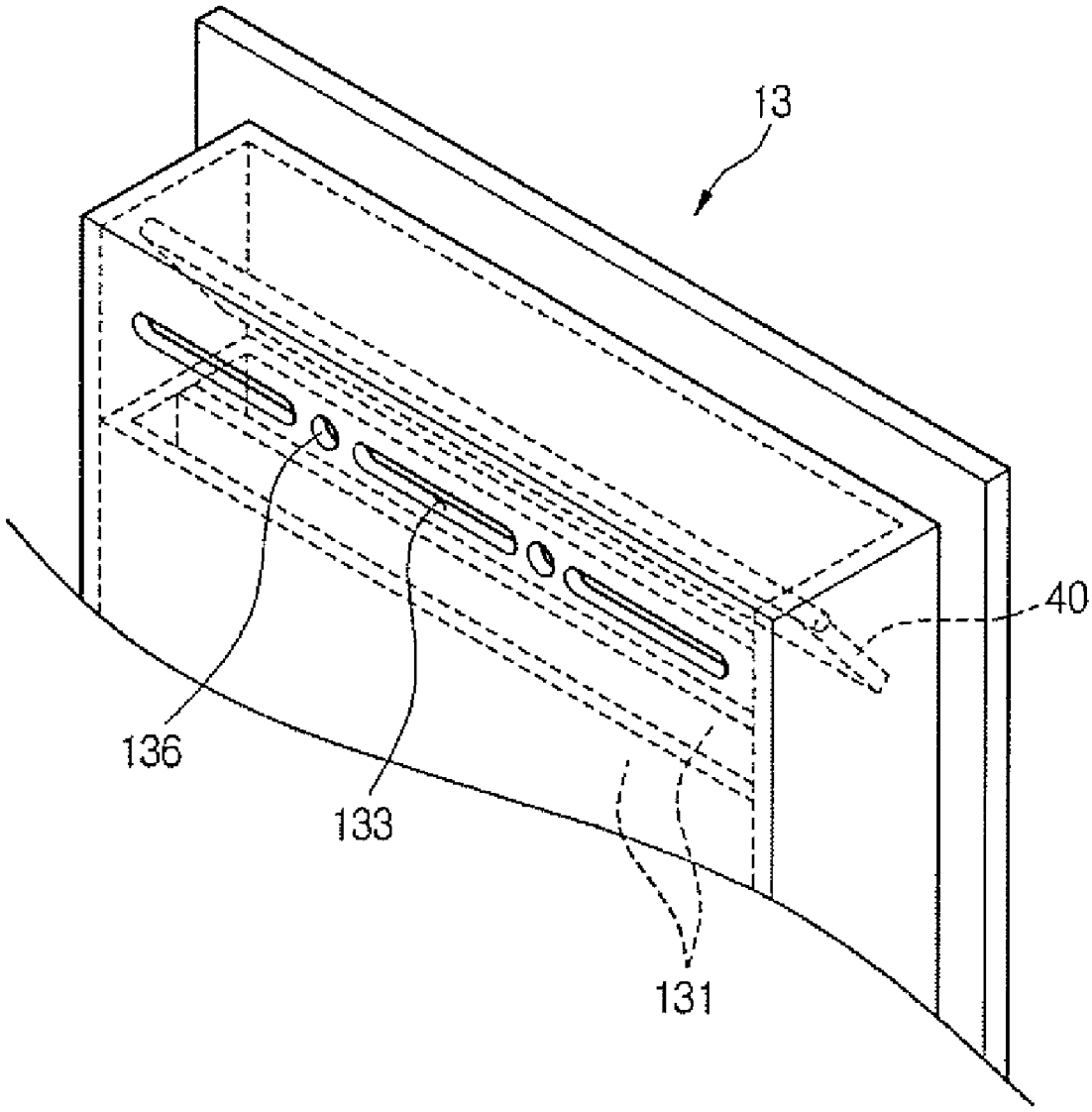
FIG. 7 is a partial perspective view of a door of an electric oven according to the second embodiment of the present invention.

FIG. 6 is a partial view of a compartment of an electric oven according to a second embodiment of the present invention, and FIG. 7 is a partial perspective view of a door of an electric oven according to the second embodiment of the present invention.

Referring to FIGS. 6 and 7, a foreign matter introduction preventing device or shield of the second embodiment is configured to selectively open and close the door cooling air hole 133, thereby preventing foreign matter from being introduced into the door 13. The foreign matter introduction preventing device includes a blocking member 40 for selectively blocking the door cooling air hole 133, and an actuator 30 that is provided on a front portion of the compartment 11 to activate the blocking member 40 between an opened position and a closed position.

In more detail, the blocking member 40 is pivotally installed in the door 13, and the actuator 30 is designed to be extended and retracted in the front-to-rear direction in order to pivot the blocking member 40. In a condition where the door 13 is closed, the blocking member 40 is pivoted by contact with the actuator 30 to open the door cooling hole 133. In a condition where the door is opened, the blocking member 40 closes the door cooling air hole 133. The actuator 30 may be of any suitable type, such as a solenoid which may extend frontward or retract rearward depending on whether electric power is applied. However, the actuator 30 is not limited to a solenoid, and any actuator that can reciprocate may be provided as the actuator 30. The actuator may be operated in any suitable manner, such as by a sensor which detects the position of the door, or the opened/closed condition of the door 13.

Actuator receiving holes 136 are formed at portions between the door cooling holes 133 so that the blocking member 40 can be pivoted by the actuator 30. In the present embodiment, the actuator 30 is inserted through the actuator receiving holes 136 in order to contact the blocking member 40. However, the actuator 30 may alternatively be inserted through the door cooling air holes 133 to contact the blocking member 40.

Figure 8:
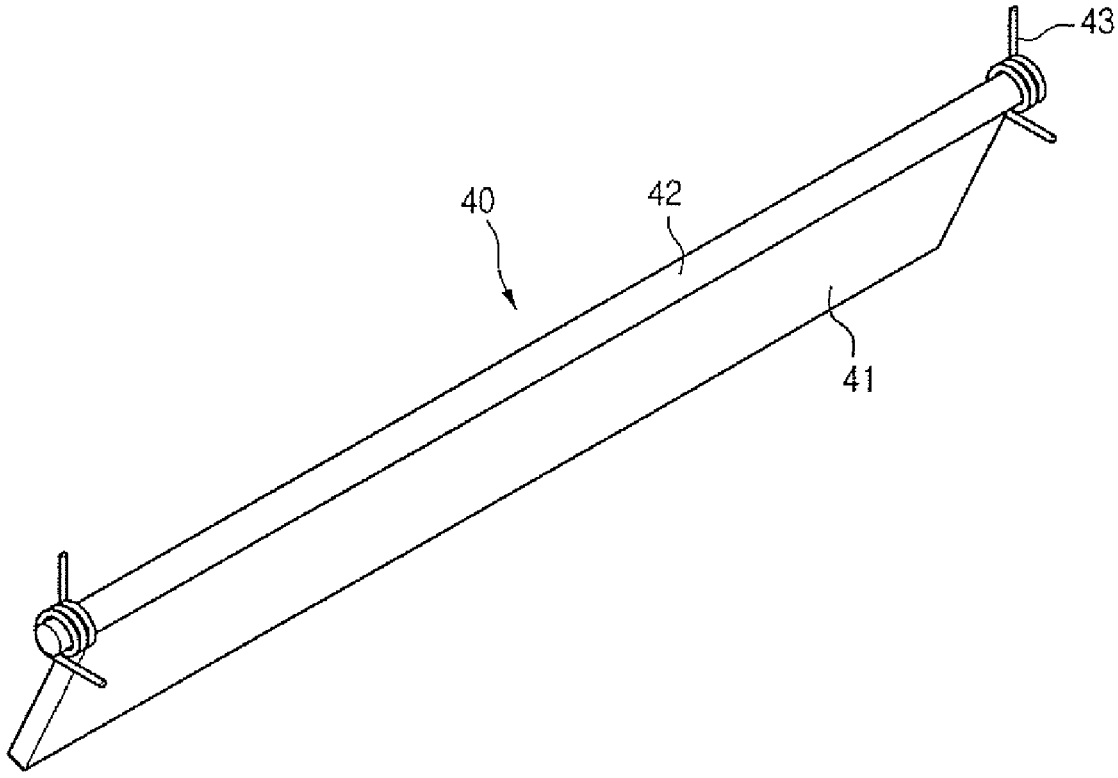
FIG. 8 is a perspective view of a shield member according to the second embodiment of the present invention.

FIG. 8 is a perspective view of a shield member according to the second embodiment of the present invention. Referring to FIG. 8, a blocking member 40 of this embodiment includes a blocking body 41 having a predetermined length and width, a rotational shaft 42 provided on an upper portion of the blocking member 41, and a spring 43 coupled to both sides of the rotational shaft 42.

The blocking body 41 may be integrally formed with the rotational shaft 42. The blocking body 41 may be biased by the spring 43 toward the door cooling air hole 133 when the door is opened. That is, in a condition where the door 13 is closed, the blocking body 41 is pivoted frontward by a predetermined angle by the actuator 30. In a condition where the door 13 is opened, the blocking body 41 is returned to its initial closing position by the spring 43. Instead of the spring 43, any other suitable device may be provided to allow the blocking body 41 to block the door cooling hole 133.

Figure 9:
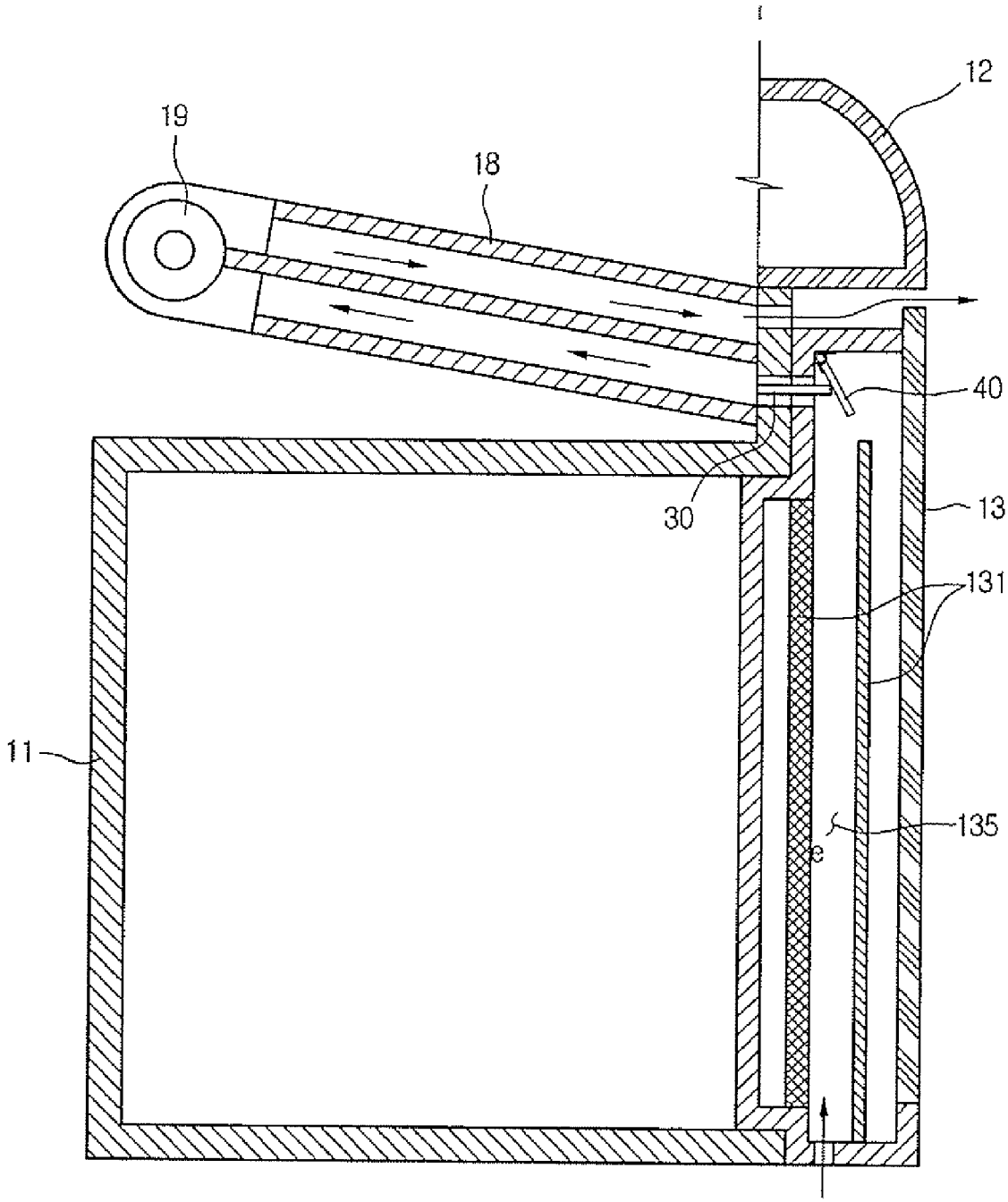
FIG. 9 is a sectional view illustrating an operation of the foreign matter introduction preventing device when an electric oven is operated.
Figure 10:
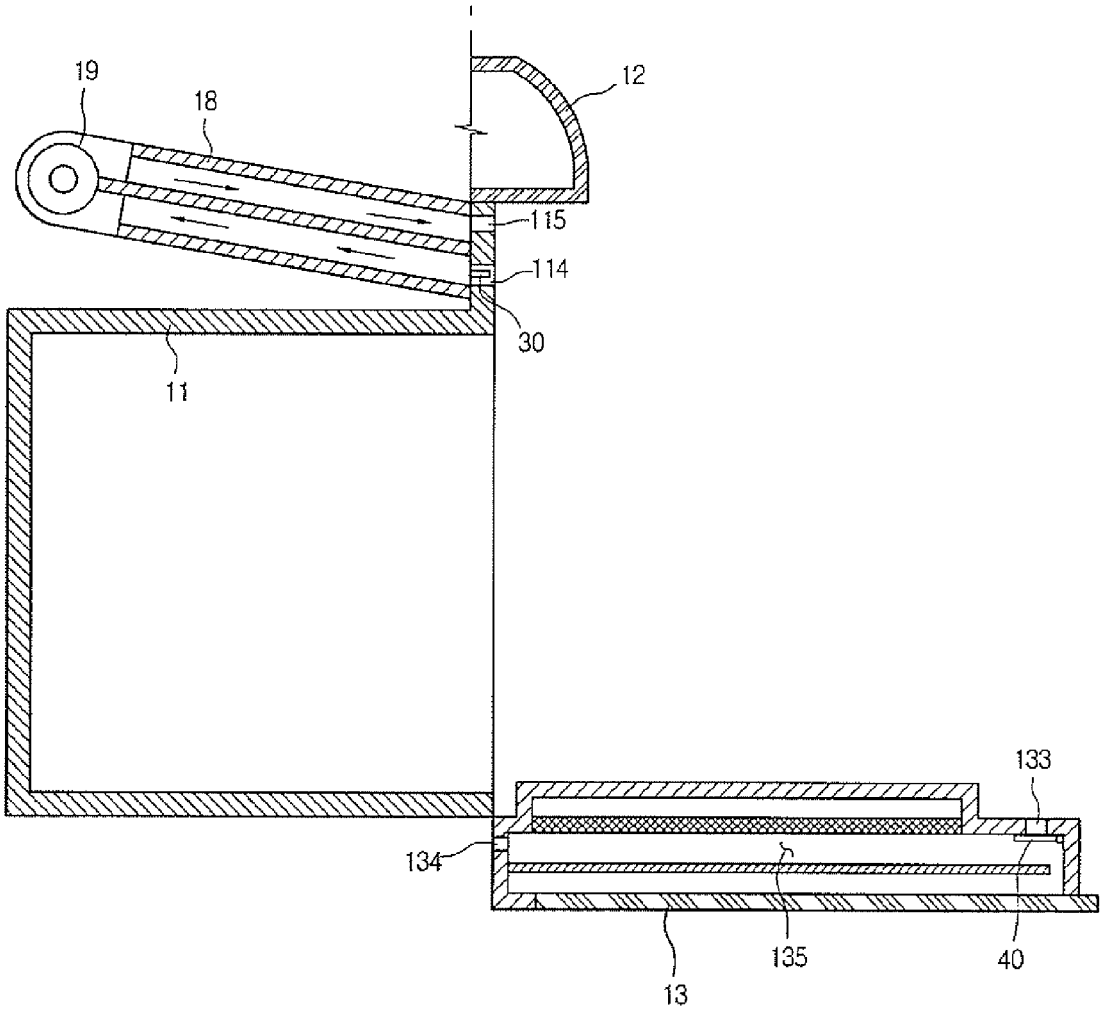
FIG. 10 is a sectional view of the foreign matter introduction preventing device in a condition where a door is opened according to the second embodiment of the present invention.

FIG. 9 is a sectional view illustrating an operation of the foreign matter introduction preventing device when an electric oven is operated, and FIG. 10 is a sectional view of the foreign matter introduction preventing device in a condition where a door is opened according to the second embodiment of the present invention.

Referring to FIGS. 9 and 10, a blocking member 40 closes the door cooling air hole 133 when the door 13 is opened, and opens the door cooling air hole 133 when the door 13 is closed.

In more detail, when the door 13 is closed and the cooking button is pushed, the cooling duct 18 communicates with the cooling passage 135 of the door 13. The blocking member 40 pivots by a predetermined angle to open the door cooling air hole 133. The blocking member 40 is pivoted frontward by the actuator 30. In this condition, the room air introduced into the door 13 cools the door 13 and is directed to the cooling duct 18 through the door cooling air opening 133. The air introduced into the duct 18 is discharged to the room through the exhaust opening 115.

When the door is opened 13, the actuator 30 operates in a reverse direction to retract into the compartment 11. The blocking member 40 closely contacts the inner circumference of the door around the opening 133. Therefore, the door cooling air opening 133 is closed by the blocking member 40.

The biasing force of the spring 43 is provided such that the blocking member 40 tightly closes the door cooling air hole 133, and does not pivot away from the door cooling air hole 133 due to gravity, even when the door 13 is in its horizontal opened position.

By the above-described structure, when the user opens the door 13 to take out the cooked food, the door cooling hole 133 is closed by the blocking member 40. Therefore, foreign matter falling from the cooked food cannot enter into the door 13 through the door cooling air hole 133. Instead, when the door 13 is pivoted up to the closed position, the foreign matter slides down to be collected on the bottom of the compartment 11. In this manner, the inside of the door 13 is maintained in a clean condition, and the generation of offensive odors and unsanitary conditions is prevented.

It will be apparent to those skilled in the art that various modifications and variations can be made in the present invention. Thus, it is intended that the present invention covers such modifications and variations of the invention.

The foregoing embodiments and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art.

One or more embodiments of the disclosure may be referred to herein, individually and/or collectively, by the term "invention" merely for convenience and without intending to voluntarily limit the scope of this application to any particular invention or inventive concept. Moreover, although specific embodiments have been illustrated and described herein, it should be appreciated that any subsequent arrangement designed to achieve the same or similar purpose may be substituted for the specific embodiments shown. This disclosure is intended to cover any and all subsequent adaptations or variations of various embodiments. Combinations of the above embodiments, and other embodiments not specifically described herein, will be apparent to those of skill in the art upon reviewing the description.

The above disclosed subject matter is to be considered illustrative, and not restrictive, and the appended claims are intended to cover all such modifications, enhancements, and other embodiments which fall within the true spirit and scope of the present invention. Thus, to the maximum extent allowed by law, the scope of the present invention is to be determined by the broadest permissible interpretation of the following claims and their equivalents, and shall not be restricted or limited by the foregoing detailed description.

Although the invention has been described with reference to an exemplary embodiment, it is understood that the words that have been used are words of description and illustration, rather than words of limitation. As the present invention may be embodied in several forms without departing from the spirit or essential characteristics thereof; it should also be understood that the above-described embodiment is not limited by any of the details of the foregoing description, unless otherwise specified. Rather, the above-described embodiment should be construed broadly within the spirit and scope of the present invention as defined in the appended claims. Therefore, changes may be made within the metes and bounds of the appended claims, as presently stated and as amended, without departing from the scope and spirit of the invention in its aspects.

What is claimed is:

1. An electric oven comprising:

a door;

a compartment having an internal space that is selectively closed by the door, the door having a cooling air opening on a surface facing the compartment, the compartment having an intake opening configured to receive air exhausted through the cooling air opening, the cooling air opening being faced with the intake opening when the door is in a closed position; and a shield element that prevents foreign matter from entering into the door through the cooling air opening, wherein the shield element includes a blocking member provided on the door and configured to selectively open and close the cooling air opening, and an actuator provided on the compartment and configured to engage the blocking member, wherein the actuator drives the blocking member to open the cooling air opening when the door is in a closed position, the blocking member closes the cooling air member when the door is in a opened position and blocks communication of the door and the intake opening of the compartment.

2. The electric oven according to claim 1, wherein the shield element further includes an elastic member coupled to the blocking member and configured to bias the blocking member toward the cooling air opening when the door is in an opened condition.

3. The electric oven according to claim 2, wherein the elastic member biases the blocking member such that the blocking member is prevented from pivoting away from the cooling air opening when the door is in a fully opened condition.

4. The electric oven according to claim 1, wherein the door includes a receiving hole on a surface facing the compartment, a portion of the actuator being inserted into the receiving hole.

5. The electric oven according to claim 1, wherein a portion of the actuator is inserted into the cooling air opening.

6. The electric oven according to claim 1, wherein the actuator is extended forward when the door is in a closed condition, and the actuator is retracted when the door is in an opened condition.

7. The electric oven according to claim 1, wherein the blocking member is spaced from the cooling air opening to open the cooling air opening when the door is in a closed condition, and the blocking member tightly contacts an inner surface of the door to close the cooling air opening when the door is in an opened condition.

8. The electric oven according to claim 1, wherein the compartment includes an exhaust opening through which the air received into the intake opening is exhausted, and a duct communicating the intake opening with the exhaust opening.

9. An electric oven comprising:

a compartment having an intake opening and an exhaust opening at a front portion thereof;

a duct connecting the intake opening and the exhaust opening;

a door that selectively opens and closes the compartment, the door including a cooling air opening in communication with the intake opening, the cooling air opening being faced with the intake opening when the door is in a closed position; and a shield element that selectively closes the cooling air opening depending on whether the door is in an opened or a closed condition, wherein the shield element includes a blocking member provided on the door and configured to selectively open and close the cooling air opening, and an actuator provided on the compartment and configured to selectively engage the blocking member, wherein the actuator drives the blocking member to open the cooling air opening when the door is in a closed position, the blocking member closes the cooling air opening when the door is in a opened position and blocks communication of the door and the intake opening of the compartment.

10. The electric oven according to claim 9, wherein the shield element further includes an elastic member coupled to the blocking member and configured to bias the blocking member toward the cooling air opening when the door is in an opened condition.

11. The electric oven according to claim 9, wherein the actuator is extended forward when the door is in a closed condition, and the actuator is retracted when the door is in an opened condition.

12. The electric oven according to claim 9, wherein the blocking member is spaced from the cooling air opening to open the cooling air opening when the door is in a closed condition, and the blocking member tightly contacts an inner surface of the door to close the cooling air opening when the door is in an opened condition.

* * * * *